US005123374A

United States Patent [19]

McMillan

[11] Patent Number: 5,123,374

[45] Date of Patent: Jun. 23, 1992

[54] RELEASABLE TOGGLE LOCKING MOORING HOOK

[76] Inventor: John H. McMillan, 465 N. 45th, #405, Seattle, Wash. 98103

[21] Appl. No.: 672,551

[22] Filed: Mar. 20, 1991

[51] Int. Cl.[5] ..... B66C 1/34; B66C 1/38

[52] U.S. Cl. ..... 114/230; 294/82.27; 114/252; 24/134 KB

[58] Field of Search ..... 280/446.1, 449, 452, 280/453; 294/82.1, 82.24, 82.27, 82.3, 82.31, 82.33, 82.34, 86.4, 88, 74, 75, 103.1, 104; 114/215, 217, 230, 247, 249, 252, 253; 180/14.5; 172/261, 264–267; 74/529, 532; 292/95, 96, 101, 108; 24/115 F, 115 R, 132 R, 132 WL, 134 KB, 134 L

[56] References Cited

U.S. PATENT DOCUMENTS

| | | | |
|---|---|---|---|
| 1,056,308 | 3/1913 | Thies | 114/252 |
| 1,242,809 | 10/1917 | Irwin | 294/82.33 |
| 2,896,995 | 7/1959 | Stephens | 294/82.33 |
| 3,054,635 | 9/1962 | Voss | 294/82.33 |
| 3,436,795 | 4/1969 | Hill | 294/82.34 |
| 3,761,122 | 9/1973 | Epstein | 294/82.33 |
| 3,762,757 | 10/1973 | Epstein | 294/82.33 |
| 3,811,720 | 5/1974 | Epstein | 294/82.34 |
| 4,658,748 | 4/1987 | Epstein | 114/217 |

*Primary Examiner*—Joseph F. Peters, Jr.
*Assistant Examiner*—Clifford T. Bartz
*Attorney, Agent, or Firm*—Trask, Britt & Rossa

[57] ABSTRACT

An improved releasable toggle locking mooring hook (10) having a releasable hook (20), toggle linkage (89), a stop/release mechanism (119), a self locking safety latch (126) and a self release mechanism (251) adapted to provide a secure locking mooring hook and a low friction, low effort releasing means while mooring hook is under heavy tensile load. In the mooring of ships, boats and barges to a dock or oil well platform, a line, usually under tension, is run from the ship to a mooring means mounted on the dock or platform. When it is desired that the ship leave this moorage, this mooring means can be actuated manually, mechanically or by a pre-set tensioned self releasing means to release mooring line and thus, allow the ship to sail. This mooring means is identified as a releasable toggle locking mooring hook (10) of this invention.

10 Claims, 6 Drawing Sheets

RELEASABLE TOGGLE LOCKING MOORING HOOK

TECHNICAL FIELD

This invention relates to releasable mooring hooks, specifically to an improved toggle locking mooring hook with means to combine and allow a secure locking hook and quick releasing means notwithstanding the magnitude of the connected tensile load and with means to self release a mooring line when tension on the line exceeds a predetermined tension level.

BACKGROUND OF THE INVENTION

The mooring of ships, boats and barges to a dock or platform requires that a mooring line be run from the ship and secured to the dock specifically retaining the mooring line to a stationary secure fitting affixed to the dock. This stationary secure fitting may be a releasable hook which can disengage the mooring line when necessary allowing the ship to leave its moorage.

Heretofore, releasable mooring hooks as applied to the marine industry utilize locking and releasing methods such as sliding load supports, spring loaded pins, pivoted latches, swivel locking arms, trip levers and a rotating catch disclosed in U.S. Pat. No. 4,658,748 issued to Epstein on Apr. 21, 1987, and in U.S. Pat. Nos. 3,761,122; 3,762,757; 3,811,720; 4,034,992; and 4,389,907. These and similar methods have addressed functional locking and releasing means for heavy tensile loads. Unfortunately, the release mechanisms of such methods absorb an excessive amount of the tensile load resulting in increased friction of the mechanisms and requiring an inordinate amount of force by the user to release them and premature fatigue of the mechanisms that causes a decrease in the locking security of the devices.

In order to transfer this increased tensile load from the release mechanism to the connecting body of the device and still allow ease of release and locking security, devices, such as that taught by Epstein, provide compound release mechanisms to dissipate the tensile load. This results in complex and bulky devices not easily handled and costly to manufacture.

Heretofore, no low friction, low cost releasable mooring hooks have been presented which utilize a simple toggle locking and releasing mechanism as a sole means to transfer the tensile load from the releasing mechanism to the body and securely lock and release a mooring line under heavy tensile load without substantial effort by the user and undo stress to working parts of the device.

Further, no releasable toggle locking mooring hooks have been heretofore presented which have means to release a mooring line either remotely by electrical or hydraulic means or manually.

Still further, no releasable toggle locking mooring hooks have been heretofore presented which have a rotatable, releasable hook which, upon release activation, completely opens solely by the gravitational pull to the weighted outward end of hook rather than by the tension applied by the mooring line.

Devices, as in Epstein, disclose inwardly weighted releasable hooks which will not open completely after release is activated unless tension is applied to mooring hook. Owners and operators of such devices are not shielded from the possibility of liability of damage or delays caused by a mooring line becoming obstructed by external sources such as a piling or the edge of the dock. Without sufficient tension such a mooring line would be retained in the mooring hook while the delay or damage is occurring even though release of the mooring device is in effect.

The line running from the dock or platform to the ship or boat or barge is under tension and increased tension can usually be applied to the line by mechanical winches aboard such ships. A releasable mooring hook affixed to the dock or platform which automatically trips and releases the line when the tension on the line exceeds a predetermined tension can be utilized rather than a hook which requires manual or mechanical release means.

Emergencies, such as rough water, high winds, onshore power failures, the absence of dock or platform personnel or the necessity of the ship to leave its moorage without delay, may require that the mooring line tension be increased beyond the predetermined tension level causing the automatic release of the mooring line from the mooring hook, thus allowing the ship to leave its moorage without any on-shore assistance.

A device, such as Epstein discloses in U.S. Pat. No. 4,658,748 on Apr. 21, 1987, shows a releasable hook with self releasing means at a pre-set tension level but offering no other means to release the hook.

Heretofore, no releasable mooring hooks have been presented which combine in one mooring hook several means to release a mooring line including manual, electrical, hydraulic and self releasing means at a pre-set tension level.

SUMMARY OF THE INVENTION

The present invention is directed to a novel releasable mooring hook:

(a) having a toggle locking and releasing means adapted to reduce friction providing a device that can be released under heavy tensile load without substantial effort by the user;

(b) having a toggle locking and releasing means whose locking security increases with increased tensile load without a substantial increase in the effort required to release mooring hook;

(c) having few working parts and thus, is lightweight and relatively inexpensive to manufacture;

(d) having a built-in, self-locking safety latch preventing inadvertent release of hook but which automatically disengages lock when release is activated;

(e) having a rotatable, releasable hook which, upon release activation, completely opens solely by the gravitational pull to the weighted outward end of the hook without the dependence of mooring line tension to open the mooring hook and without the possible liability of damages or delays caused by an externally obstructed mooring line with insufficient tension to be completely released from mooring hook;

(f) having self releasing means at a pre-set tension level while allowing lock and release of self locking safety latch and providing means to vary the predetermined tension required to release the hook.

BRIEF DESCRIPTION OF THE DRAWINGS

The foregoing and other feature advantages of the present invention will be more readily appreciated as the same becomes better understood from the detailed description when taken in conjunction with the accompanying drawings, wherein.

DETAILED DESCRIPTION

Referring to FIGS. 1-6, a releasable toggle locking mooring hook 10 formed in accordance with the present invention is illustrated. Ideally, the working parts of the mooring hook are constructed of heat treated alloy metals. A two piece frame comprises a first side plate 12 and a second side plate 14.

Figure 1:
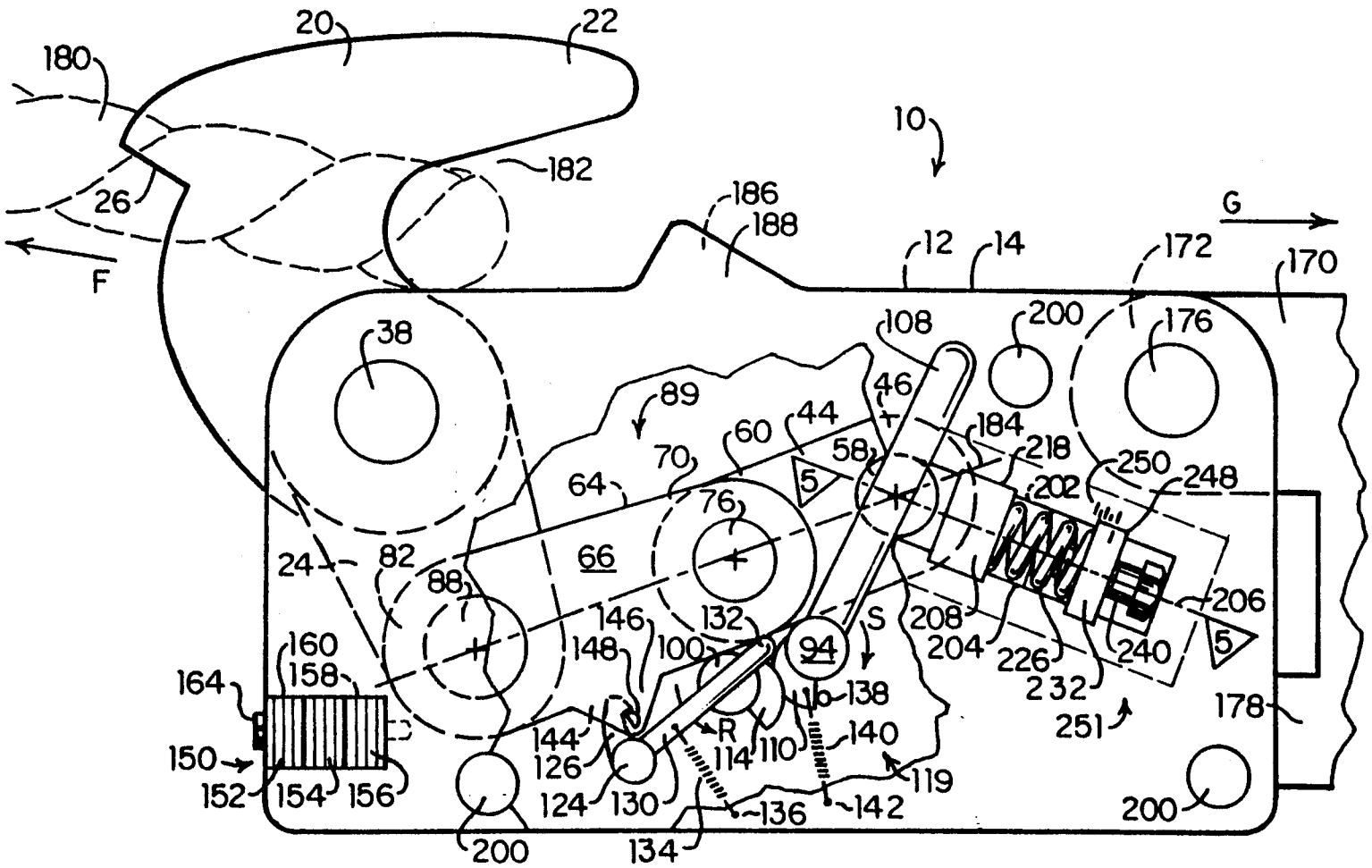
FIG. 1 is a side elevation view of a representative embodiment of the releasable toggle locking mooring hook in the locked position formed in accordance with the present invention.
Figure 2:
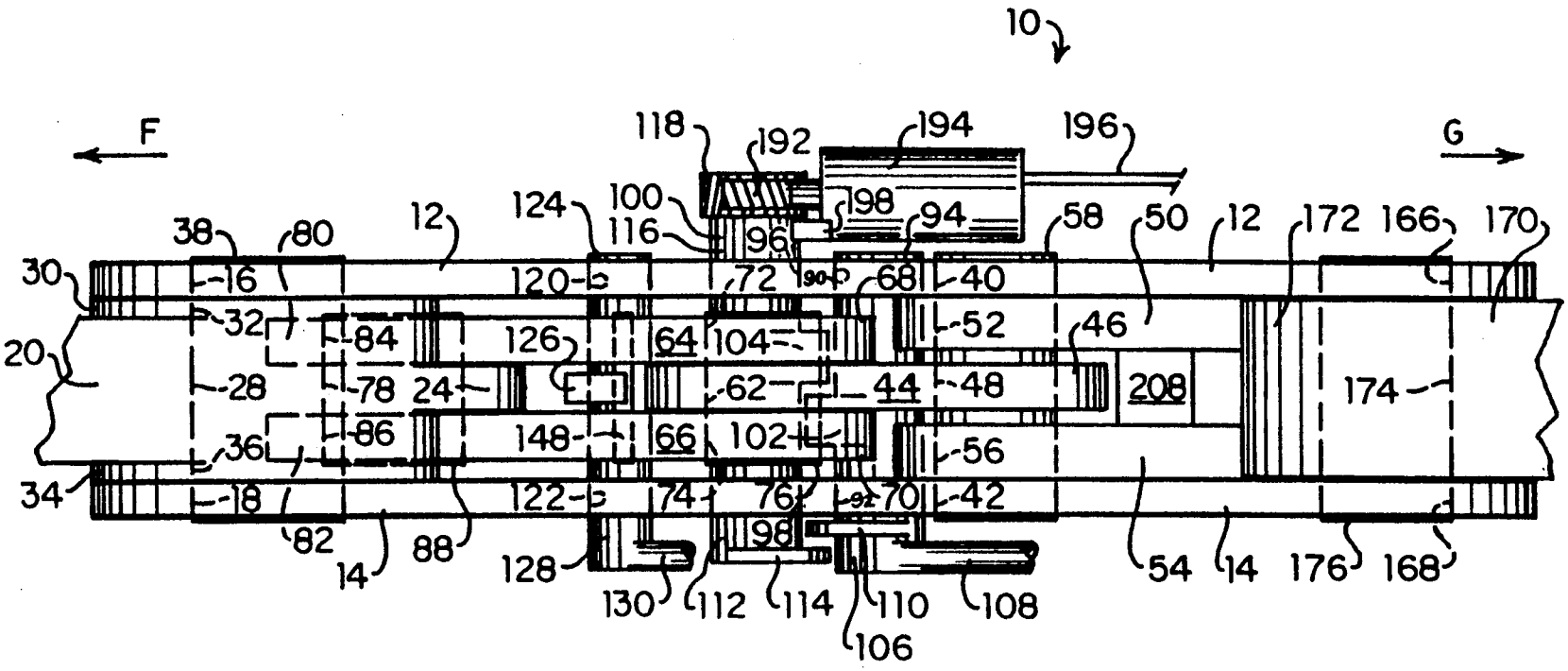
FIG. 2 is a top plan view of the mooring hook of FIG. 1.

It is seen in the left part of FIGS. 1 and 2 in the first side plate 12 there is a first passageway 16. In the second side plate 14 there is a second passageway 18 aligned with passageway 16.

There is a rotatable hook 20 having an outer hook portion 22 and an inner portion 24. Also, the hook 20 has a flat surface or a shoulder 26.

In the hook 20 there is a passageway 28.

There is a boss 30 welded to the hook 20. The boss 30 has a passageway 32 and is between the hook 20 and the first side plate 12.

There is a boss 34 welded to the hook 20. The boss 34 has a passageway 36 and is between the hook 20 and the second side plate 14.

A shaft, viz., a bolt, 38 extends through the passageway 16, passageway 32, passageway 28, passageway 36, and passageway 18, so that the hook 20 can rotate on the shaft 38.

Figure 5:
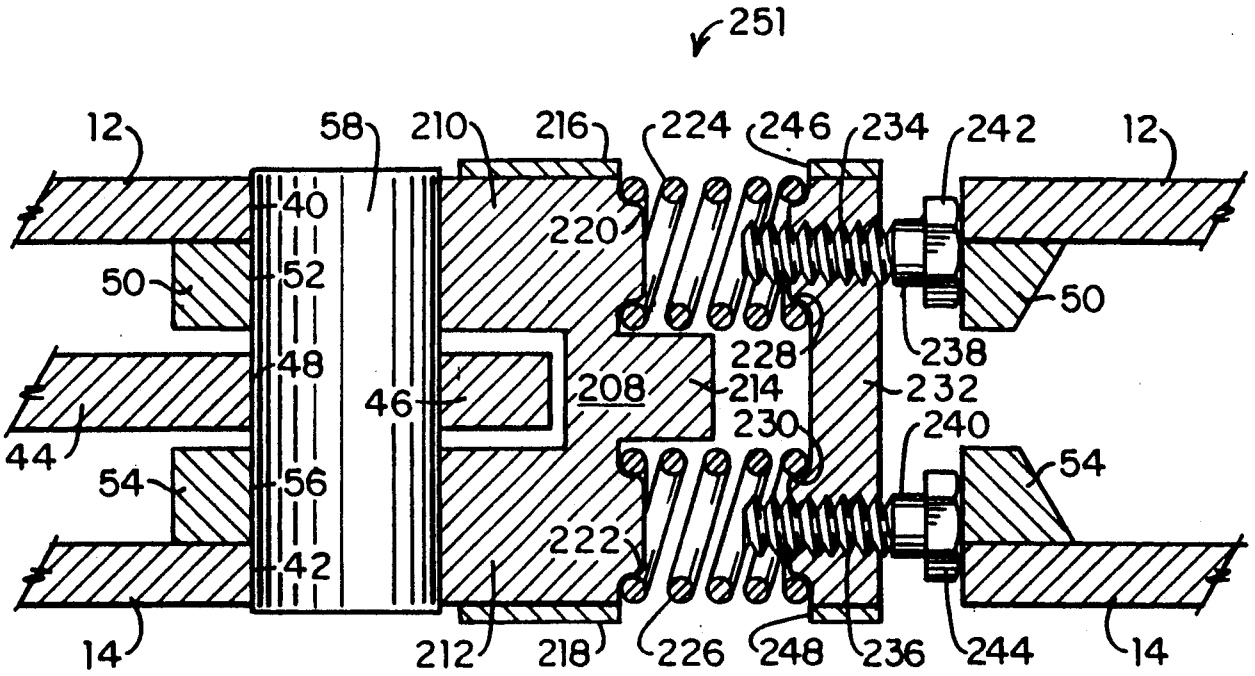
FIG. 5 is a sectional view taken from a plane indicated by a line in FIGS. 1 and 4.

In FIGS. 1, 2 and 5 it is seen that near the center of the plates 12 and 14 there are passageways. In plate 12 there is a passageway 40. In plate 14 there is a passageway 42.

There is a toggle link 44 having a fixed pivot portion 46. In the fixed pivot portion 46 there is a passageway 48.

There is an extended boss 50 welded to the first side plate 12. The boss 50 has a passageway 52 and is between the toggle link 44 and the first side plate 12.

There is an extended boss 54 welded to the second side plate 14. The boss 54 has a passageway 56 and is between the toggle link 44 and the second side plate 14.

A shaft 58 extends through the passageway 40, passageway 52, passageway 48, passageway 56, and passageway 42 so that the fixed pivot portion 46 of toggle link 44 can rotate on the shaft 58. The shaft 58 may be a bolt.

The toggle link 44 has a movable pivot portion 60. In the movable pivot portion 60 there is a passageway 62.

There is a lever link 64 and a lever link 66. Movable pivot portion 60 of toggle link 44 lies in between a toggle portion 68 of lever link 64 and a toggle portion 70 of lever link 66. Portion 68 of lever link 64 has a passageway 72. Portion 70 of lever link 66 has a passageway 74.

A shaft 76 extends through the passageway 72, passageway 62, and passageway 74 so that the portion 60 of toggle link 44 and portions 68 and 70 of lever links 64 and 66 respectively, can rotate on the shaft 76.

In the inner portion 24 of hook 20 there is a passageway 78.

Inner portion 24 of hook 20 lies in between hook portion 80 of lever link 64 and hook portion 82 of lever link 66. Portion 80 of lever link 64 has a passageway 84. Portion 82 of lever link 66 has a passageway 86.

A shaft 88 extends through the passageway 84, passageway 78, and passageway 86 so that the portion 24 of hook 20 and the portions 80 and 82 of lever links 64 and 66 respectively, can rotate on the shaft 88.

A four point toggle linkage 89, better depicted in FIGS. 1-4, is formed to have two fixed pivots at shafts 38 and 58 and two movable pivots at shafts 76 and 88.

It is seen in the central part of FIGS. 1-3, below shaft 76 in the first side plate 12 there is a passageway 90. In the second side plate 14 there is a second passageway 92 aligned with the passageway 90.

A shaft 94 extends through passageway 90 and passageway 92 wherein shaft 94 is rotatable.

Adjacent to passageway 90 in the first side plate 12 there is a passageway 96. Adjacent to passageway 92 in the second side plate 14 there is a passageway 98 aligned with passageway 96.

A shaft 100 extends through passageway 96 and passageway 98 wherein shaft 100 is rotatable.

Shaft 94 has a release cam 102, better depicted in FIGS. 1-3, formed near the center of shaft 94 partially below portion 70 of lever link 66 and partially below portion 60 of toggle link 44.

Shaft 100 has a release cam 104 formed near the center of shaft 100 partially below portion 68 of lever link 64 and partially below portion 60 of toggle link 44.

Shaft 94 has a lever end portion 106 extending outward from second side plate 14. Portion 106 is formed with a lever arm 108 extending at a right angle to the axis of shaft 94. Portion 106 of shaft 94 is also formed with a safety latch cam 110 formed in parallel with cam 102. It is seen in FIGS. 1, 3 and 4 below shaft 94 there is a peg stop 138 welded to outer side of second side plate 14. Lower portion of cam 110 is urged against stop 138 by an urging means such as a tension spring 140 connecting cam 110 and second side plate 14 at a hook 142.

Shaft 100 has a cam end portion 112 extending outward from second side plate 14. Portion 112 is formed with a second safety latch cam 114 formed in parallel with cam 104.

Shaft 100 has a propulsion end portion 116 extending outward from first side plate 12. Portion 116 is formed with a rotary transmission means 118.

Cams 102, 104, 110 and 114 are formed and positioned on shafts 94 and 100 respectively so as not to interfere with each other or the adjacent shafts during the rotation of shafts 94 and 100.

Cam 102 on shaft 94 and cam 104 on shaft 100 shown as a stop/release mechanism 119, function jointly or independently as a stop, braking the lowering movement of shaft 76 and as a releasing mechanism or pressure means when shafts 94 and 100 are rotated and will be referred to in regard to the locking and releasing operation of the mooring hook 10.

Cams 110 and 114 function jointly or independently as a releasing mechanism or pressure means when shafts 94 and 100 are rotated and will be referred to in regard to the releasing of the self locking safety latch.

Figure 3:
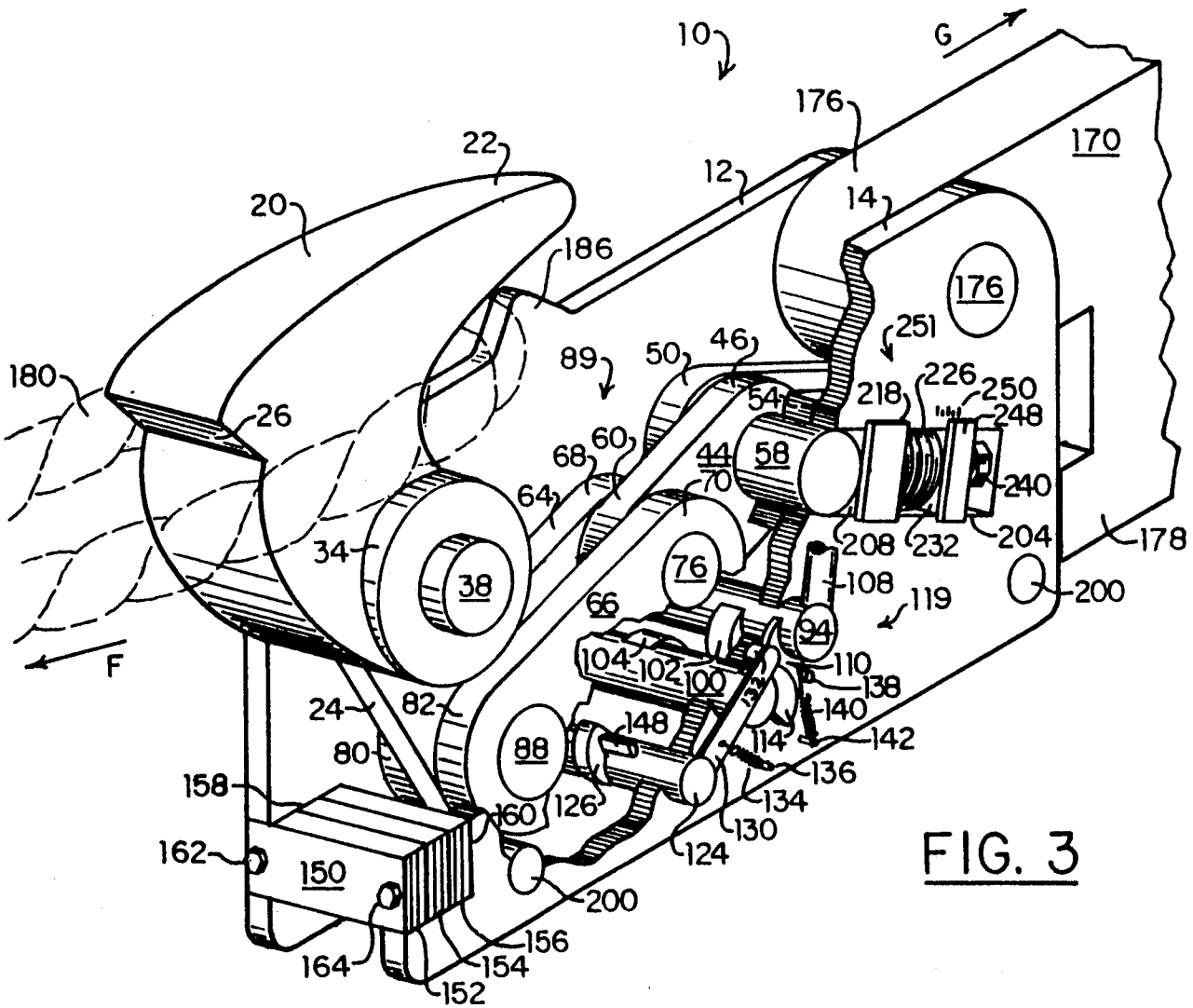
FIG. 3 is a perspective view of the mooring hook of FIG. 1.
Figure 4:
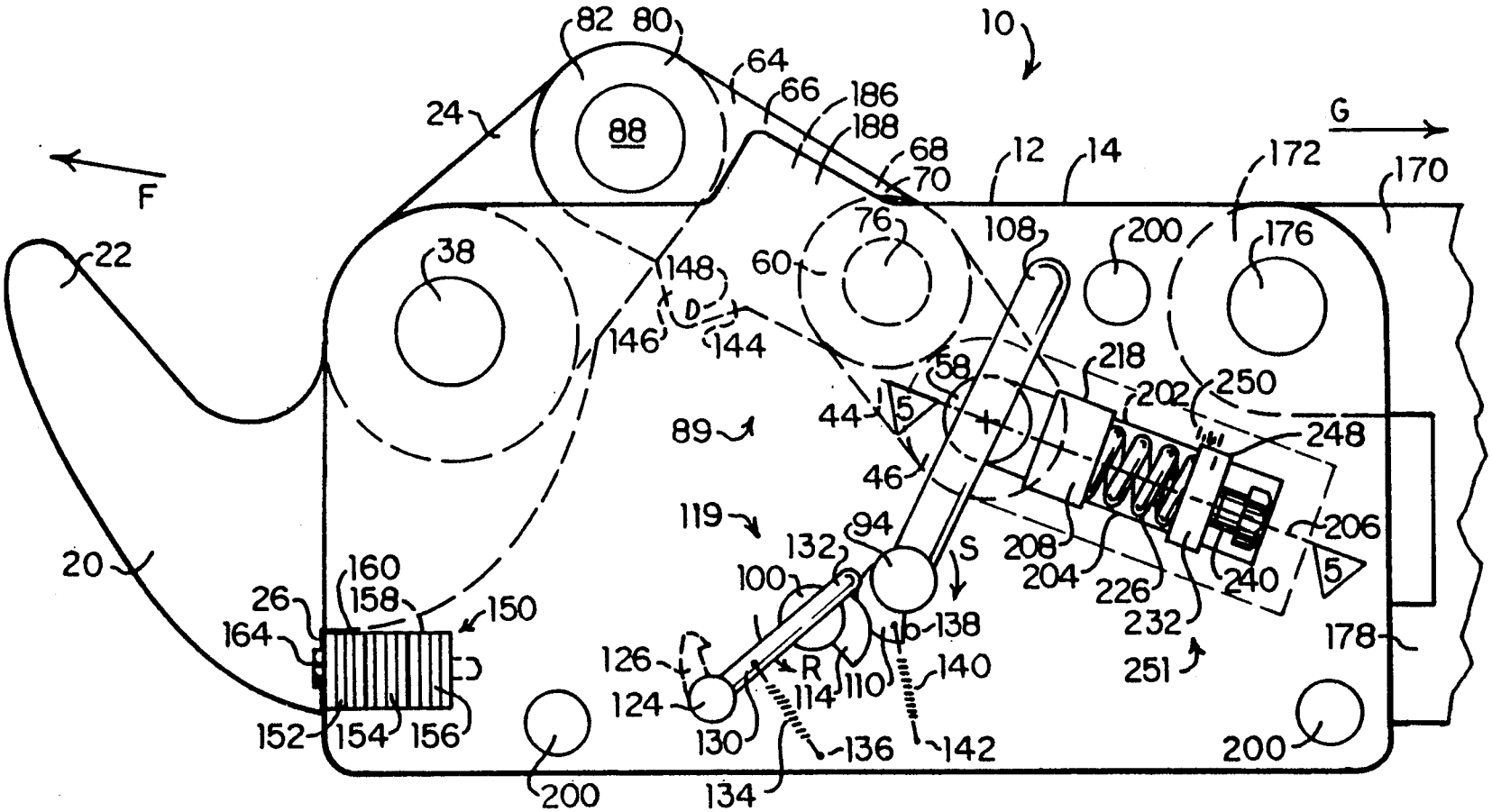
FIG. 4 is a side elevation view of the mooring hook of FIG. 1 in the released position.

It is seen in FIGS. 1-3 below lever links 64 and 66 in the first side plat 12 there is a passageway 120. In the second side plate 14 there is a second passageway 122 aligned with passageway 120.

A safety latch shaft 124 extends through passageway 120 and passageway 122 wherein shaft 124 is rotatable.

Shaft 124 has a self locking safety latch 126, better depicted in FIGS. 1, 3 and 4, formed near the center of shaft 124 and extending upward between lever links 64 and 66.

Shaft 124 has a leverage end portion 128 extended outward from second side plate 14. Portion 128 is formed with a lever arm 130, best shown in FIGS. 1, 3 and 4, extended at a right angle to the axis of shaft 124. The outward end of lever arm 130 is formed with a cam rider 132. Cam rider 132 is urged to rest on both cams 110 and 114 by urging means such as a tension spring 134 connecting lever arm 130 with second side plate 14 at a hook 136.

It is seen in FIGS. 1, 3 and 4 on the under side of lever link 64 there is a lobe 144 and on the under side of lever link 66 there is a second lobe 146 formed in parallel with lobe 144. Affixed between lobe 144 and lobe 146 there is a latch pin 148 shaped to be received by safety latch 126 extending from shaft 124 upward in between lobes 144 and 146.

Cams 110 and 114, cam rider 132, lever arm 130, shaft 124, safety latch 126 and latch pin 148 combine to function as a self locking and releasing mechanism when shaft 94 and 100 are rotated and will be referred to in regard to the self locking safety latch operation of mooring hook 10.

In FIGS. 1, 3 and 4, it is seen that near the lower left part that there is a bumper block 150. The bumper block 150 comprises metal plates 152, a cushion, such as a rubber insert 154, and then metal plates 156. The bumper block 150 may be attached between the plates 12 and 14 within the receiving recess 158 and 160 by a fastening means such as a bolt 162 secured to the first side plate 12 and a bolt 164 secured to the second side plate 14.

Bumper block 150 is positioned below hook 20 in the rotational path of hook 20 and aligned to receive shoulder 26 on hook 20 so as to stop and dampen the rotational velocity of hook 20 upon its release.

As seen in FIGS. 1-4 in the upper right side of hook 10, in the first side plate 12, there is a passageway 166. In the second side plate 14 there is a passageway 168 aligned with passageway 166.

There is a mounting brace 170 having a mounting pivot portion 172 lying between plate 12 and plate 14. Portion 172 has a passageway 174.

A shaft 176, viz., a bolt, extends through the passageway 166, passageway 174 and passageway 168, so that mooring hook 10 can be mounted to rotate vertically on the mounting brace 170.

The lower portion of brace 170 is formed with a bumper 178 so as to stop the vertical rotation of mooring hook 10.

Figure 6:
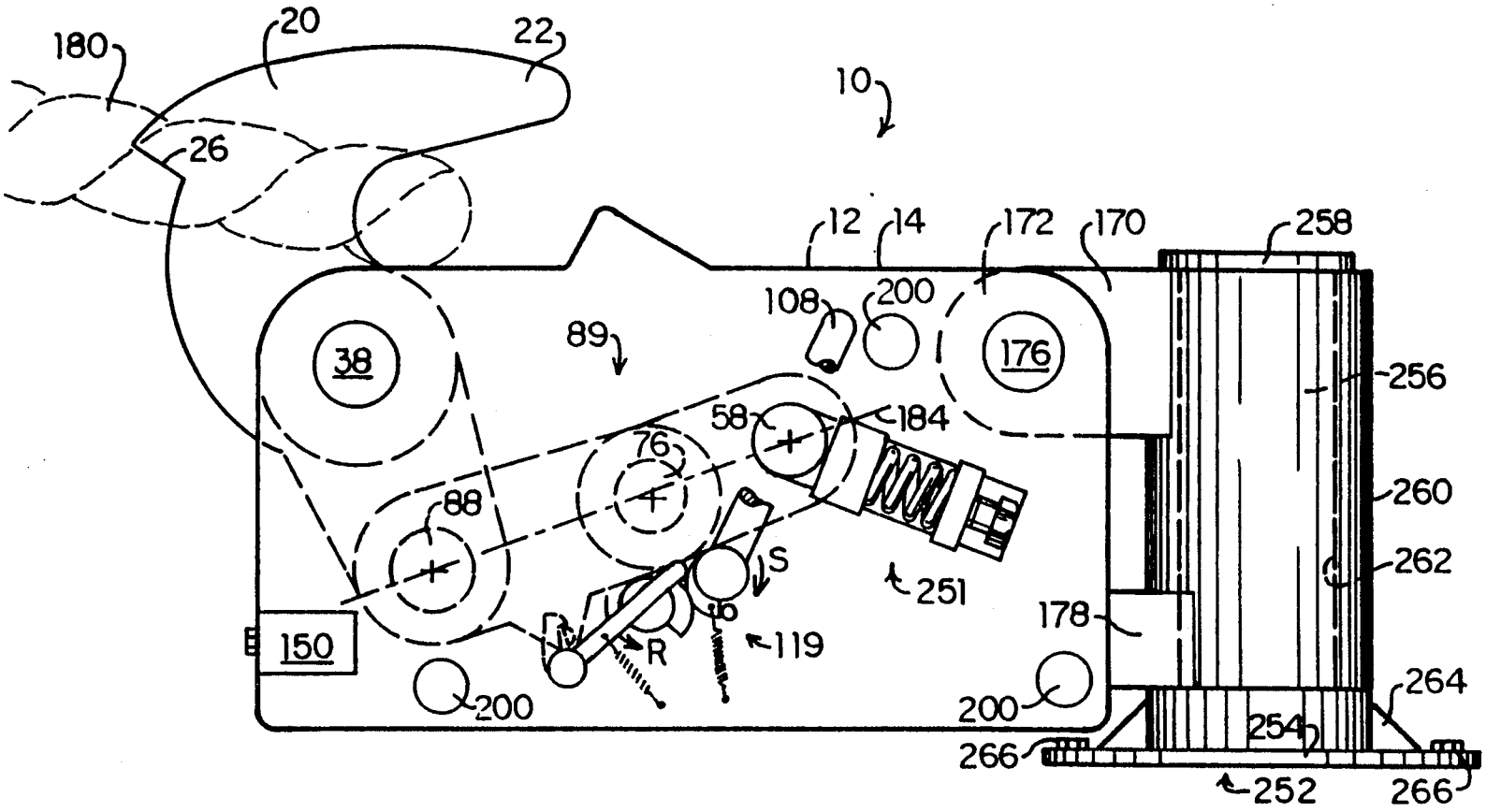
FIG. 6 is a side elevation view of the mooring hook of FIG. 1 in relation with a connected mounting brace and mounting bracket.

Mounting brace 170 is mounted to a mounting bracket 252. The mounting bracket 252, as seen in FIG. 6, comprises the base 254, an upright standard 256 and a cap 258. Mounting brace 170 further comprises an upright cylinder 260. Passageway 262 within cylinder 260 is adapted to receive upright standard 256. It is seen that the mooring hook 10 can rotate horizontally in a first direction around the standard 256. Also, the hook 10 can rotate vertically in a second direction around shaft 176. The first direction and the second direction are at, substantially, right angles to each other.

It is seen that there are a number of upright support braces 264 connecting with the upright standard 256 and the base 254. Further, it is seen that there are several bolts 266 through the base 254 so as to be able to attach the hook 10 to a dock or other support such as an oil well platform or the deck of a boat. It is to be understood that the base 254 may be attached by means other than a bolt, such as welding, to a dock or to an oil well platform or the deck of a boat.

The operation of the mooring hook 10 is as follows. The releasable toggle locking mooring hook 10 is designed as a manually, electrically or hydraulically releasable mechanism with self releasing means requiring very low release forces compared to the restrained load and a release means with very low friction.

Two opposing tensile force vector directions as applied to mooring hook 10 are shown by arrow F at the hook 20 and by arrow G at the mounting brace 170.

Generally, a mooring line 180 from a ship is placed in recess 182 formed by outer hook portion 22 after the hook 20 is manually rotated into the locked position as shown in FIGS. 1 and 3.

As hook 20 is rotated into the locked position, the toggle linkage 89 formed by the pivoted lever links 64 and 66 and toggle link 44 is lowered. As the toggle linkage 89 is lowered, the axis of shaft 76 will, at some point, be lowered below the center line 184 formed between the axis of shafts 58 and 88. At this point the joint at shaft 76 of lever links 64 and 66 and toggle link 44 comes to rest on shafts 94 and 100 and the hook 20 of mooring hook 10 is in a securely locked position. Any attempt by the tensile load applied by line 180 to hook 20 serves to drive the toggle linkage 89 harder against shafts 94 and 100 further enhancing locking security of mooring hook 10.

The safety latch 126 is having a biased upper portion formed to be urged aside by the lowering of latch pin 148 as lever links 64 and 66 are lowered into the locked position of FIGS. 1 and 3. This position allows the latch 126 to freely latch over the pin 148 by the urging of spring 134. Thus, the axis of shaft 76 is retained below line 184 and a secure safety locking mechanism is formed preventing the inadvertent release of hook 20.

The release of mooring hook 10 is performed with minimal effort by urging the axis of shaft 76 away from the locked position of FIGS. 1 and 3, and moving it a very short distance up to and across line 184. From the point after which the axis of shaft 76 is raised above line 184, it is from then onward on the releasing side of line 184 and hook 20 begins a releasing rotation terminating in the position of hook 20 in FIG. 4.

Once the axis of shaft 76 is raised above line 184, hook 20 is urged further into the released position by means of both the tension applied by mooring line 180 to hook 20 and by the gravitational force acting on the heavily weighted outward portion 190 of hook 20, should there be no tension applied by line 180 to hook 20.

As shown in FIGS. 1 and 4, among the many methods which may be utilized to urge the axis of shaft 76 away from the locked position of FIGS. 1 and 3 and move it across line 184, the preferred embodiment is herein disclosed. Shaft 94 is rotated causing cam 102 to rotate or shaft 100 is rotated causing cam 104 to rotate.

The rotating force direction of release of shaft 94 is shown by arrow S. The rotating force direction of release of shaft 100 is shown by arrow R.

To release mooring hook 10, shaft 94 is rotated manually in the direction of arrow S by means of lever arm 108. Cam 102, formed on shaft 94, thus urges toggle linkage 89 upward and raises the axis of shaft 76 above line 184 which allows hook 20 to rotate and release mooring line 180. Lever arm 108 and cam 102 are then urged of their own accord by spring 140 to return to the locking position wherein the lower portion of cam 110 is urged against stop 138.

Similarly, to release mooring hook 10, shaft 100 is rotated electrically or hydraulically in the direction of arrow R by means of a rotary transmission means 118. Best depicted in FIG. 2, rotary transmission means 118, formed in the propulsion end portion 116 of shaft 100 extending outward from first side plate 12, is rotatably propelled by a worm drive 192 driven by an electrical or hydraulic propulsion means 194 supplied with power by lines 196. Cam 104, formed on shaft 100, thus urges toggle linkage 89 upward and raises the axis of shaft 76 above line 184 with subsequent rotation of hook 20 and release of line 180.

A switch means 198 is interacting between the rotation of rotary transmission means 118 and the propulsion means 194, so that, upon release activation, propulsion means 194 causes rotary transmission means 118 to rotate shaft 100 approximately 360 degrees. Thus, the release function of cam 104 on shaft 100 is performed after which cam 104 is returned to the locking position.

The release of safety latch 126, best shown in FIGS. 1 and 3, is performed in conjunction with the rotation of either shaft 94 or shaft 100 by means of lever arm 130 connecting cam rider 132 with shaft 124. As release of the device 10 is activated, the rotation of either shaft 94 or shaft 100 in their respective directions of release, S or R, urges the upward raising of cam rider 132 by means of cams 110 or 114 formed on shafts 94 and 100 respectively. The relationship between the cams 110 and 114 and the cam rider 132 is such that by the time cam 102 or 104 begins to raise toggle linkage 89 and the axis of shaft 76 toward line 184, cam 110 or 114 has raised cam rider 132, rotated shaft 124 and thus, urged safety latch 126 to one side of latch pin 148 sufficiently to allow free release of pin 148, toggle linkage 89, and, subsequently, mooring line 180.

As shafts 94 and 100 are automatically returned to the locking positions following release activation, safety latch 126, by means of spring 134, is also urged to the locking position in preparation for the next locking procedure.

A further safety measure is provided by lobe 186 on upper edge of first side plate 12 and lobe 188 on upper edge of second side plate 14. Lobes 186 and 188 are positioned so as to maintain mooring line 180 within hook 20 at recess 182 should the tension on line 180 be relaxed at any time.

Structural members 200, affixed to plates 12 and 14 and shown in FIGS. 1, 3 and 4, are located in strategic positions so as to bridge the space created by plates 12 and 14 and add rigidity and strength to mooring hook 10.

FIGS. 1, 3 and 4 and especially 5, illustrate a preferred embodiment of means to allow mooring hook 10 to release line 180 of its own accord under tension at a pre-set tension level. Such a means is shown as a self release mechanism 251 located adjacent to toggle shaft 58.

The passageway formed by the alignment of passageway 40 in the first side plate 12 and passageway 52 in the extended boss 50 is extended downward and to the right of shaft 58 to form a slot 202.

Similarly, the passageway formed by the alignment of passageway 42 in the second side plate 14 and passageway 56 in the extended boss 54 is extended downward and to the right of shaft 58 to form a slot 204, paralleling slot 202. Slots 202 and 204 are centered on a line 206 which intersects the axis of shaft 58.

Within the slots 202 and 204 adjacent to and formed to receive shaft 58 there is a shaft cradle 208 comprising a first side plate portion 210 and a second side plate portion 212, and a central yoke portion 214 connecting portions 210 and 212.

Cradle 208 is slidable within slots 202 and 204 along line 206 sufficient to lower shaft 58 a short distance along line 206. Guides 216 and 218 which extend above and below the edges of slots 202 and 204 are affixed to the outer surface of cradle 208 so as to retain cradle 208 within slots 202 and 204 during the slidable movement of cradle 208.

A circular shoulder 220 is formed on the right side of portion 210 of cradle 208. A circular shoulder 222 is formed on the right side of portion 212 of cradle 208. Shoulders 220 and 222 are formed to receive and retain one end of compression springs 224 and 226 respectively. The other ends of springs 224 and 226 are received and retained by shoulders 228 and 230 formed on one side of a threaded tension adjustment bar 232. Bar 232 is slidable within slots 202 and 204 along line 206 and internally threaded at threads 234 and threads 236 in line with the axis of springs 224 and 226 respectively. Bar 232 is thus, threaded to receive bolts 238 and 240 having heads 242 and 244 respectively. Heads 242 and 244 are urged by springs 224 and 226 against the projection formed by the joining of boss 50 and plate 12 and the joining of boss 54 and plate 14. Guides 246 and 248 which extend above and below the edges of slots 202 and 204 are affixed to the outer surface or ends of bar 232 so as to retain bar 232 within slots 202 and 204 during the slidable movement of bar 232.

Bolts 238 and 240, when rotated at heads 242 and 244 respectively, serve to provide means to adjust the amount of compression that is being applied by springs 224 and 226 to cradle 208 and, subsequently, to shaft 58.

Indicia 250 located on plates 12 and 14 above guides 246 and 248 is provided as means to allocate the placement of bar 232 along slots 202 and 204 and thus, set the springs 224 and 226 to the desired compression level against shaft 58.

The operation of the self release mechanism 251 of mooring hook 10 is as follows. The compression force of springs 224 and 226 against shaft 58 is pre-set (by the rotation of bolt heads 242 and 244 which compresses springs 224 and 226) to be overcome at a predetermined compression (tension) level.

For safety purposes, this tension level would be set at a level slightly lower than the level at which mooring line 180 would break, so as to prevent damage to and allow free release of line 180.

As tension on mooring line 180 and hook 20 exceeds the predetermined self releasing tension level, the tensile force as applied in the direction of arrow F to hook 20 is rotatably transferred (as compression force) along line 184 toward shaft 58. This opposing compression overcomes the force of springs 224 and 226 and urges shaft 58 to be dislodged from collective passageways 40, 52, 56 and 42 and to follow a path along line 206 within the confines of slots 202 and 204.

The angle at which line 206 intersects line 184 is sufficient to allow the movement of shaft 58 to free the latch pin 148 from the restraint of safety latch 126. The continued movement of shaft 58 then causes the axis of shaft 58 to move center line 184 toward the axis of shaft 76. Further movement of shaft 58 urges the axis of shaft 76 across line 184 from the locking side of line 184 to the releasing side of line 184, thereby, allowing toggle linkage 89 to release hook 20 and mooring line 180.

Mooring line 180 is thus, self released at a predetermined tension level while still maintaining the locking security of safety latch 126.

As tensile force F urges hook 20 into the released position of FIG. 4, the elimination of that force then allows the compression force of springs 224 and 226 to urge shaft 58 to return to the locking position in preparation for the next locking procedure of mooring hook 10.

Due to the possible extreme pressure as applied to shaft 58 by springs 224 and 226 via cradle 208, shaft 58 may be rendered unrotatable and it is, thus, necessary to allow a spacial tolerance between fixed pivot portion 46 of toggle link 44 and shaft 58 at passageway 48 sufficient to allow portion 46 of link 44 to rotate freely on shaft 58.

As will be readily appreciated from the foregoing description, a number of advantages evident in the releasable toggle locking mooring hook include:

(a) having a toggle locking and releasing means adapted to reduce friction providing a device that can be released under heavy tensile load without substantial effort;

(b) having a toggle locking and releasing means whose locking security increases with increased tensile load without a substantial increase in the effort required to release mooring hook;

(c) having few working parts and thus, is lightweight and relatively inexpensive to manufacture;

(d) having a built-in, self locking, safety latch preventing inadvertent release of hook but which automatically disengages lock when release is activated;

(e) having a rotatable, releasable hook which, upon release activation, completely opens solely by the gravitational pull to the weighted outward end of hook without the dependence of mooring line tension to open the hook and without the possible liability of damages or delays caused by a mooring line obstructed externally with insufficient tension to be completely released from mooring hook;

(f) having self releasing means at a pre-set tension level while allowing lock and release of self locking safety latch and providing means to vary the predetermined tension required to release the hook.

It must be understood that the form of the present invention as described herein is to be taken as a representative embodiment of the same and that changes may be made in the shape, size, strength, and configuration without departing from the spirit and the scope of the invention.

For instance, shafts 94 with cam 102 and shaft 100 with cam 104 may be substituted with a leverage mechanism or other means to restrict the movement of shaft 76 and toggle linkage 89 or raise the axis of shaft 76 above line 184.

A single compression means may be utilized in place of springs 224 and 226 and a single threaded tension adjustment means or other adjustment means may be utilized in place of the bar 232 and bolts 238 and 240.

Outer hook portion 22 of hook 20 may be split and formed with two outer hook portions or claws. The space formed in between both claws could engage a chain link and mooring hook 10 could function as an anchor chain stopper and assist in securing chain such as the chain of the anchor of a ship at the hawse pipe.

Further, standard 256 and base 254 can be formed with larger support braces and mounting brace 170 can be formed with a cylinder which is rotating horizontally on a pin secured to and in parallel with standard 256 on base 254. Thus, the supporting strength of mounting bracket 252 is enhanced.

Further, releasable toggle locking mooring hook 10 may be utilized as a towing hook and mounted on the deck of a towing vessel and the mooring line 180 would then serve as a tow line.

Still further, releasable toggle locking mooring hook 10 may be utilized in the releasing of aircraft being ejected from aircraft carriers or any other application requiring the use of a connecting device which is releasable while under heavy tensile load.

Consequently, the invention is to be limited only by the scope of the appended claims.

The embodiments of the invention in which an exclusive property or privilege is claimed are defined as follows:

1. A releasable hook for use with a high-tensile load-bearing object, comprising:

(a) a frame;

(b) a hook means rotatably mounted on said frame to move between a first position wherein said hook means is engaged with the load-bearing object and a second position wherein said hook means is disengaged from the load-bearing object;

(c) means for releasably locking said hook means in said first position, said releasable locking means comprising:

(i) a shaft slidably mounted on said frame to slide along a longitudinal axis;

(ii) a toggle linking means having a first end pivotally mounted on said hook means to pivot about a first pivotal axis and a second end pivotally mounted on said slidable shaft to pivot about a second pivotal axis that is substantially parallel to the first pivotal axis, said toggle linking means further including a hinged central portion that rotates about a rotational axis that is substantially parallel to the first and second pivotal axes to enable movement of said central portion, such that as said central portion moves so that the rotational axis is moved into alignment with the first and second pivotal axes, said first and second ends of said toggle linking means are urged away from each other to thereby move said hook means into said first position, and as said central portion moves so that the rotational axis is moved out of alignment with the first and second pivotal axes, said first and second ends of said toggle linking means are urged toward each other to thereby move said hook means into said second position;

(d) means for stopping movement of said central portion of said toggle linking means, said stopping means being formed to prevent movement in one direction of said central portion such that as said central portion moves the rotational axis in a first direction out of alignment with the first and second pivotal axes, said stopping means prevents further movement of said central portion in said first direction and permits movement of said central portion in an opposite second direction whereby when the rotational axis of said central portion is positioned out of alignment in said first direction and said hook means is subjected to a load exerted by the load-bearing object, the force of the load is transmitted to said central portion of said toggle linking means to urge said central portion to move in said first direction toward and against said stopping means to lock said toggle linking means in position to thereby hold said hook means in said first position, and, when the rotational axis of said central portion is positioned out of alignment with the first and second pivotal axes in said second direction, the force of the load moves away from said stopping means to thereby move said hook means to said second position;

(e) means for urging said slidable shaft toward said first end of said toggle linking means with a predetermined amount of force such that when said hook means is in said first position and subjected to a load that transmits a force of a greater magnitude and opposing said predetermined amount of force of said urging means, said second end of said toggle link is moved away from said first end such that the second pivotal axis is moved out of alignment with the first pivotal axis and the rotational axis of said central portion of said toggle linking means such that said central portion is urged in said second direction to thereby move said hook means from said first position to said second position and disengage said load-bearing object; and (f) means for moving said central portion of said toggle-linking means in said second direction away from said stopping means and out of alignment with said first and said second pivotal axes when said central portion is adjacent said stopping means whereby said hook means is moved from said first position to said second position.

2. The hook of claim 1, wherein said urging means is adjustable to alter said predetermined amount of force.

3. The hook of claim 2, wherein said moving means comprises a shaft rotatably mounted on said frame and having a cam means thereon such that as said shaft rotates, said cam means is urged into and out of engagement with said central portion of said toggle-linking means.

4. The hook of claim 3, wherein said stopping means comprises a rotatable shaft mounted on said frame and said cam means comprises a lobe formed on said rotatable shaft whereby said rotatable shaft is actuated to rotate said lobe into and out of engagement with said central portion of said toggle-linking means to urge said toggle-linking means away from said rotatable shaft so that the rotational axis is out of alignment with said first and second pivotal axes to cause said toggle-linking means to move said hook means into said second position.

5. A high-tensile load-bearing releasable engaging device, comprising:

(a) a load-bearing object engaging means for movement between a first position wherein said engaging means is engaged with a load-bearing object and a second position wherein said engaging means is disengaged with the load-bearing object;

(b) toggle-linking means for releasably locking said engaging means in said first position;

(c) a cam means for urging said toggle-linking means to move said engaging means from said first position to said second position;

(d) means for positively latching said toggle-linking means to hold said engaging means in said first position, said latch means coupled to said cam means such that actuation of said cam means unlatches said latch means; and (e) means for releasing said engaging means from said first position when said engaging means is subjected to a predetermined load.

6. The device of claim 5, wherein said releasing means comprises a slidable shaft coupled to said toggle-linking means and means for urging said slidable shaft in a first direction such that said toggle-linking means maintains said engaging means in said first position with a predetermined amount of force, whereby when said engaging means is subjected to a load that transmits an opposing force of a greater magnitude than the predetermined amount of force of said urging means, said slidable shaft moves in a second direction against the force of said urging means to cause the toggle-linking means to release said engaging means and enable said engaging means to move from said first position to said second position.

7. The device of claim 6, wherein said urging means is adjustable to enable adjustment in the amount of force applied by said urging means.

8. The device of claim 6, further comprising means for indicating the level of predetermined force exerted by said urging means.

9. The device of claim 6, further comprising a bumper means for stopping the movement of the engaging means as said engaging means moves from said first position to said second position.

10. The device of claim 6, wherein said engaging means is weighted whereby when said hook is in a horizontal position, said hook is further urged by the force of gravity to move from said first position to said second position.

* * * * *